US009272505B2

(12) United States Patent
Gemelli

(10) Patent No.: US 9,272,505 B2
(45) Date of Patent: Mar. 1, 2016

(54) PRINTING APPARATUS WITH PAD

(71) Applicant: TOSH s.r.l., Quinto de Stampi, Rozzano, MI (IT)

(72) Inventor: Caterina Gemelli, Pavia (IT)

(73) Assignee: TOSH S.R.L., Quinto de Stampi, Rozzano, MI (IT)

( * ) Notice: Subject to any disclaimer, the term of this patent is extended or adjusted under 35 U.S.C. 154(b) by 0 days.

(21) Appl. No.: 14/535,753

(22) Filed: Nov. 7, 2014

(65) Prior Publication Data

US 2015/0158288 A1 Jun. 11, 2015

(30) Foreign Application Priority Data

Dec. 10, 2013 (IT) ..... MI2013A2054

(51) Int. Cl.

| | |
|---|---|
| ***B41F 17/00*** | (2006.01) |
| ***B41F 17/34*** | (2006.01) |
| ***B41F 35/00*** | (2006.01) |
| ***B41F 17/30*** | (2006.01) |

(52) U.S. Cl.

CPC ..... *B41F 17/001* (2013.01); *B41F 17/006* (2013.01); *B41F 17/30* (2013.01); *B41F 35/00* (2013.01); *B41P 2235/242* (2013.01); *B41P 2235/244* (2013.01)

(58) Field of Classification Search

CPC ..... B41F 17/001; B41F 17/006; B41F 17/30; B41F 35/00; B41P 2235/244; B41P 2235/242; B41M 5/0082; B41M 5/0088; B41M 5/0047

USPC ..... 101/41, 44, 163

See application file for complete search history.

(56) References Cited

U.S. PATENT DOCUMENTS

| | | | | |
|---|---|---|---|---|
| 6,276,266 | B1 * | 8/2001 | Dietz | B41F 17/001 101/41 |
| 6,604,458 | B1 * | 8/2003 | De Volder | B41F 17/001 101/163 |
| 7,644,657 | B1 * | 1/2010 | Clark | B41F 17/001 101/35 |
| 7,866,260 | B1 | 1/2011 | Clark et al. | |
| 2003/0136281 | A1 * | 7/2003 | Clark | B41F 17/001 101/41 |
| 2008/0041250 | A1 * | 2/2008 | Clark | B41J 2/0057 101/217 |

FOREIGN PATENT DOCUMENTS

| | | | |
|---|---|---|---|
| EP | 1 053 882 | A2 | 11/2000 |
| EP | 1171305 | A1 | 1/2002 |
| EP | 2505373 | A1 | 10/2012 |
| FR | 2986464 | A1 | 8/2013 |
| WO | 2008/021326 | A2 | 2/2008 |

* cited by examiner

*Primary Examiner* — Leslie J Evanisko
(74) *Attorney, Agent, or Firm* — Jacobson Holman, PLLC.

(57) ABSTRACT

A printing apparatus is described. The printing apparatus has at least one pad including a cavity and a printing surface, a printing device adapted to form at least one image portion on the printing surface of the least one pad, a pad moving apparatus adapted to orient the pad in a first working position in which the image portion is formed in the printing surface of the pad by means of the printing device and in a second working position, different from the first working position, in which the image portion is imprinted on the object to be decorated by pressing the pad onto the object, a further device adapted to act on the cavity of the pad to determine a flat shape of the printing surface of the entire pad in the first working position and a substantially convex shape of the printing surface of the entire pad in the second working position.

16 Claims, 13 Drawing Sheets

PRINTING APPARATUS WITH PAD

BACKGROUND OF THE INVENTION

The present invention relates to a printing apparatus with pad and provided with a printing device, in particular a digital and/or serigraphy printing device.

BRIEF SUMMARY OF THE INVENTION

Pad printing provides a usually silicone rubber, cusp shaped pad, solid or hollow inside to improve the deformation capacity, which is compressed on a flat cliché, engraved for few hundredths of a millimeter (about 15/35 micron) which at each cycle is inked and doctored (i.e., the excess ink is removed), leaving the ink only in the engraving. The sharp pad is compressed until it flattens onto the cliché and upon detaching it takes its original (sharp) shape, taking with it some of the ink contained in the engraving. The sharp shape is essential so that the pad, both in the step of gripping and releasing, does not incorporate the air between ink and pad or between ink and piece to be decorated, respectively, thereby preventing the functionality thereof. Moreover, the (appropriately designed) sharp shape serves to ensure that the pad rolls, during the image gripping and releasing step, thus flattening on the cliché and on the object so as to change its shape without creating tensions between the two contacting surfaces, which would result in slippage between the two corresponding surfaces and subsequent degradation of printing. The pad is brought by the movements of the machine onto the object to be printed and compressed thereon, where, due to its elasticity, adheres to the surface of the latter, depositing ink. The ink in contact with air during transport from the cliché to the object loses some of the solvent/thinner it contains, thereby increasing its consistency and its ability to be accurately transferred on the piece.

If the object to be printed is not flat (as the cliché is), the image undergoes a deformation which, if undesired, must be counter-deformed during the cliché engraving.

This printing cycle, if a multicolor printing is desired, is repeated multiple times on the object to be printed with different steps (as those described) using different colors.

Pad printing is a technology which allows printing convex, concave or differently shaped objects with great precision and high speed, allowing the decoration of objects whose shape normally does not allow to be decorated/encoded with other known color printing techniques, such as serigraphy printing, hot printing, off-set, flexography, inkjet, etc., which normally limit their application where the shape of the object is flat or with developable geometrical shape on the plane (such as cylindrical or conical). With pad printing, any change to the image to be imprinted onto the object to be decorated involves the manufacture of a new cliché.

Digital technology can solve part of the problems existing in the pad printing method but it is not always able to get the same level of image end quality; indeed the image, generated by a computer and sprayed directly onto the object by the inkjet heads, can be changed easily and continuously. However, it is extremely difficult, if not impossible, to print on objects having a markedly undevelopable shape (such as spherical or complex shapes with double curvature) or within concave shapes, such as a cooking dish, or within a spherical cap. This results from the fact that the digital printing technique, especially the inkjet one, works well if the nozzles which spray the ink are located very close to the object to be decorated, with distances of at most few millimeters, otherwise the fine droplets (in the order of picoliters) would lose their predetermined position. The inkjet printing technique comprises a plurality of inkjet printing heads; each printing head carries a color (there may be 1 to 5 or even more, plus the background white if the piece to be printed is dark), with sizes ranging from about 70 mm to about 120 mm. The printing heads are capable of forming images with a single step up to a height of 120 mm; the heads are 15 to 25 mm wide and are placed one next to the other parallel to the longer side, so that they pass with rectilinear motion parallel on the flat or almost flat surface to be printed, or making the cylindrical or conical piece rotate under each printing head in a sequence. Each head can print its color on the piece, one after another, thus producing a multicolor image, thus forming separate images for each color, or produce a multicolor image called "CMYK" for obtaining a photographic image.

Each printing head carries several hundred nozzles lined up on one or more rows, able to spray/dispense volumes in the order of 10-200 picoliters in each drop of ink (and many other fluids such as water based, solvent based fluids or with resin which harden by exposure to ultraviolet light), in a sustainable manner and at high frequencies without impairing the drop positioning accuracy, if sprayed from a very short distance. The finer the droplets, the more accurate and of quality is the image obtained on the piece; but the smaller the drops, the lesser they will be able to travel long distances between the head and the object without losing their correct positioning. The nozzles are able to arrange single ink droplets on an object to be decorated in predetermined positions, that is, a grid of pixels which can be very fine or very coarse or somewhere in between, but in any case they can be optimized according to applications required. Moreover, with a digital printing device with four printing heads to which four basic colors are associated, by placing the color droplets on the object, it is possible to get the visual effect of a large variety of different colors.

Therefore, the inkjet printing technique, in particular that using fine droplets required for quality printing, finds its limits in the need of printing at a short distance by means of nozzles which spray ink onto the object to be printed, and in the inability to print objects of complex shape; the solution of moving the inkjet head with a robot is not only uneasy to implement but even impossible, considering that the inkjet heads have a length of 50/120 millimeters and moreover the nozzles at the ends would be at an unacceptable distance from the surface of a convex or concave object. The use of inkjet heads of small dimensions cannot be actually considered because they require a large number of steps for the complete decoration of a piece; moreover, the use of many colors would further complicate the use of the inkjet printing heads.

The change of image to be printed with pad printing requires the replacement of the cliché with another one having the new engraving, the replacement of the color (ink) with the corresponding inking and doctoring devices or at least their washing. Both the production of said new engraved clichés and the replacement of the colors (inks) involves a considerable waste of time which, together with the costs of materials, make some limited series productions uneconomic or extremely expensive. The inkjet technique, on the other hand, solves the problem of limited productions since the (matrix-type) image can be changed many times in a infinitesimal time (as it is generated by computer); however, as already said, this technique has the limitations described above and is therefore not feasible.

Serigraphy or serigraphy printing is a technique for printing images on any substrate or surface through the use of a textile (printing textile), by depositing the ink on an object/substrate through the blank areas of the fabric.

The essential feature is of serigraphy printing inks is their thixotropy, which is the capacity of a liquid to vary its viscosity under the action of mechanical forces (or upon temperature changes) and return to the previous status upon the end of mechanical action (and to the previous temperature). This property allows the ink to pass through the textile meshes of the frame only under the pressure exerted by the printing doctor blade and to return almost, immediately to the previous viscosity without widening too much on the substrate to be serigraphy printed and without dripping from the frame. This results in accuracy of the details, high covering and printing uniformity.

There are several ways to prepare a stencil for serigraphy printing. The easiest way is to draw it by hand on paper (or film) in the desired shape and size, cut it out and attach it to the frame; or draw the negative of the image directly on the frame and apply a filler material which becomes impermeable when it is dry on the parts outside of the design.

The serigraphy printing frame is made of a very fine yarn fabric stretched on an aluminum, iron or sometimes wooded frame. Originally silk, since the 1940s, nylon or polyester have been used in its place. Some areas of the frame are blocked or covered with various substances, depending on the technique used, to form an image (a stencil is therefore created); the blocked parts will not appear in the final print. In the free parts, the printing color passes through the tiny holes in the gaps left by the warp yarns, to deposit on the surface to be printed.

The frame is then removed from the object/substrate which is then dried. The frame can be reused after being cleaned. Multicolor serigraphy printings use multiple matrices (one per color), which require keeping a perfect "printing log" during the printing step. Serigraphy printing, as the inkjet, has the feature of being able to print only on flat or nearly flat surfaces or on developable surfaces such as cylindrical or conical but not with double curvature; therefore, also with this technique it is impossible to print within cavities or on convex or concave surfaces.

In view of the prior art, the object of the present invention is to provide a printing apparatus with pad which is different from the known ones.

According to the present invention, said object is achieved by a printing apparatus comprising:

at least one pad comprising an inner cavity and a printing surface, a printing device adapted to form at least one image portion on the printing surface of the least one pad, characterized in that it comprises:

pad moving means adapted to orient the pad in a first working position, on which said image portion is formed in said printing surface of the pad by said printing device, by means of a relative movement between pad and printing device along a horizontal axis, said pad moving means being adapted to orient the pad in a second working position different from the first working position and wherein said at least one image portion is imprinted on the object to be decorated by forcing the pad onto the object, by means of a relative rectilinear movement between the pad and the object to be decorated from the bottom upwards or from the top downwards, further means adapted to act on the cavity of the pad to determine a flat shape of the printing surface of the entire pad in the first working position and a substantially convex shape of the printing surface of the entire pad in the second working position.

The innovation consists in combining some advantages of the digital printing technique and/or the serigraphy printing technique in a single printing apparatus using a pad which normally has a flat (flat or almost flat surface) printing surface and therefore able to receive the ink directly provided by one or more inkjet heads or by a serigraphy printing device which, with a known method, deposit the image to be printed on the flat rubber (usually silicon) surface of the pad. After this operation, the pad changes its shape becoming sharp, or at least roughly shaped as a spherical cap, arranging itself for the subsequent printing on the piece which takes place in the manner known in pad printing, i.e. compressing the pad on the surface of the piece. Depending on the ink technology used by the inkjet heads, immediately after the deposition of the image on the pad it may be necessary to perform a pre-drying of the ink, which must be only partial in order to increase the consistency thereof and therefore also the ability to withstand the pressing of the pad in the step of transferring onto the object, but not such as to make it no longer adhesive. Said pre-drying may also have the function of blocking the ink droplets once deposited on the pad, preventing them from being mixed together or with other colors (simultaneously received by the pad), in the lapse of time due to the arrangement of the pad in the position in which the image is to be transferred onto the object. This pre-drying, depending on the type of ink technology used, may have a slight and partial UV exposure if the ink is UV technology (a technique commonly known as "pinning" which involves the partial polymerization by UV); in the case of inks which harden by solvent evaporation or by chemical catalyzation, the pre-drying may take place by means of air jets, preferably hot. For other types of inks, if necessary, it will take place by other means.

BRIEF DESCRIPTION OF THE DRAWINGS

The features of the present invention will appear more clearly from the following description of a practical embodiment thereof, made by way of a non-limiting example with reference to the accompanying drawings, in which.

DETAILED DESCRIPTION OF THE INVENTION

Figure 6B:
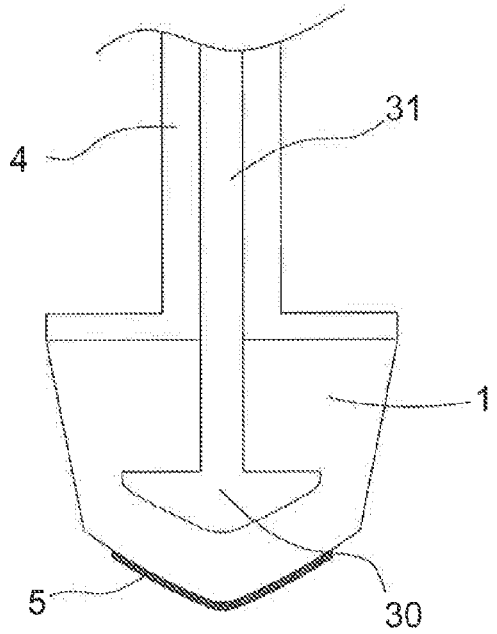
FIGS. 6*a*-6*b* show another type of pad usable for the apparatus in FIGS. 1 and 2.
Figure 6A:
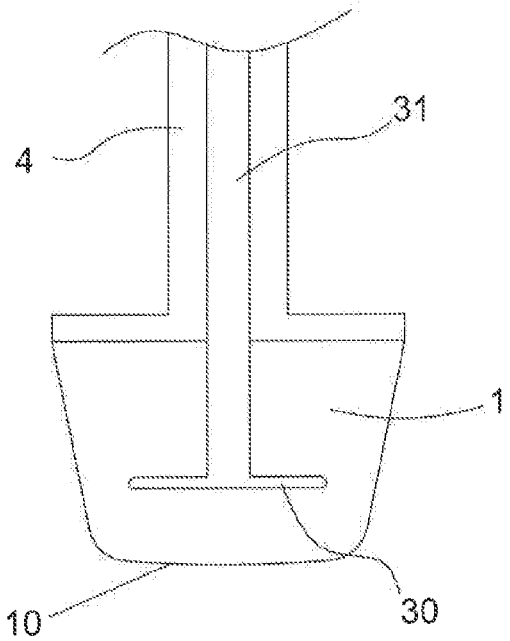
Figure 7A:
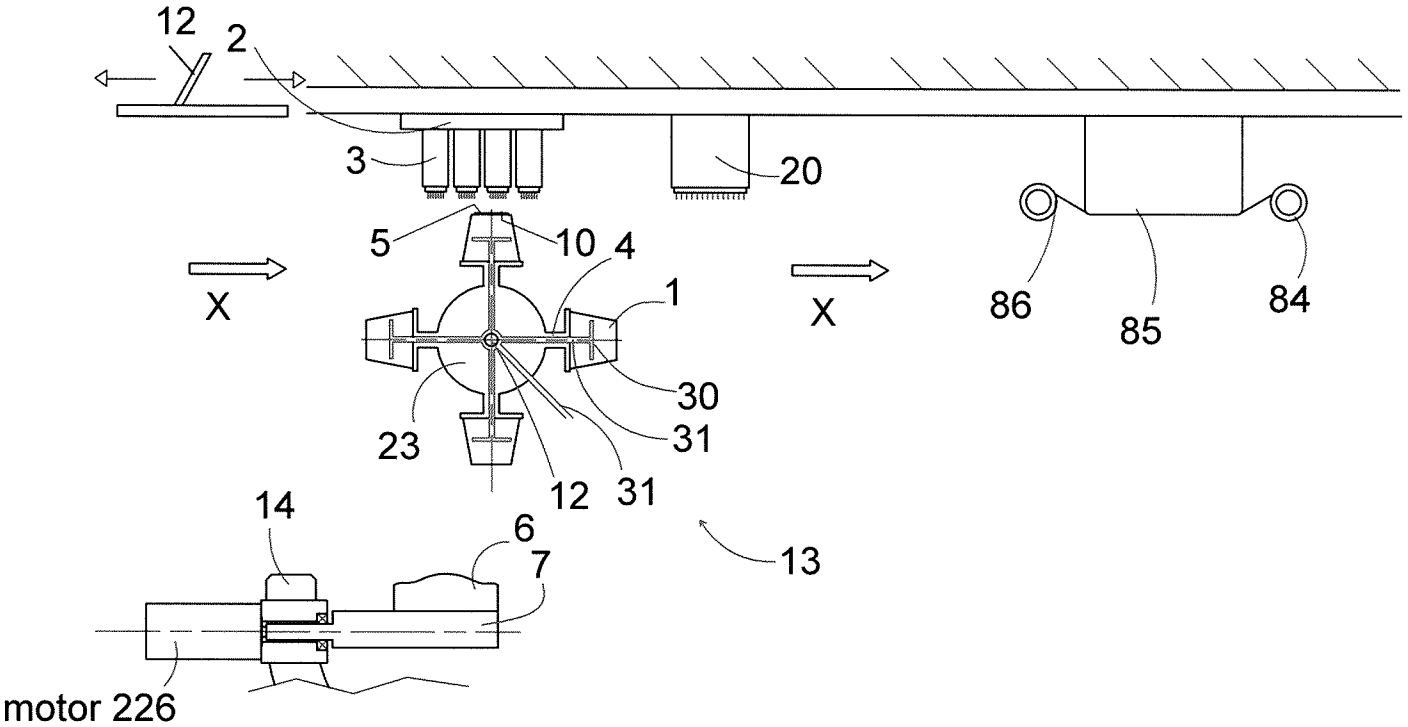
FIGS. 7*a*-7*b* show in more detail the apparatus in FIGS. 1 and 2 in the first working position (FIG. 7*a*) and in the second working position (FIG. 7*b*)
Figure 7B:
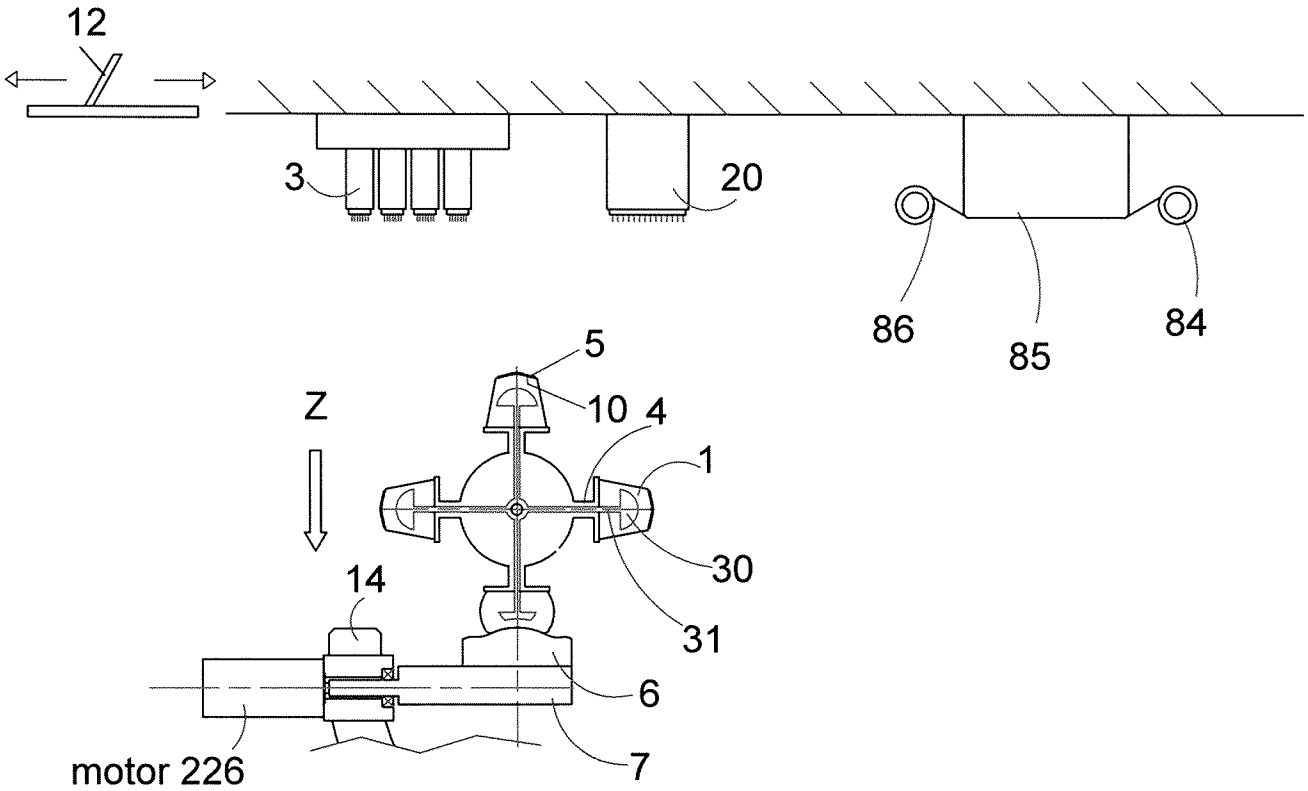

FIGS. 1-7*b* show a printing apparatus with pad according to an embodiment of the present invention. Said apparatus comprises at least one pad 1, a printing device 2, preferably a digital printing device and in particular inkjet device 2, comprising at least one printing head 3 but preferably a plurality of printing heads 3, each provided with nozzles adapted to spray ink or other solution, such as glue, on the printing surface 10 of the pad for the formation of at least one image portion 5 or the whole image 5 on the pad, preferably an ink image, a structure 13 adapted to arrange pad 1 in a position A (FIG. 1) adapted to receive the ink image 5 from device 2 by the displacement of pad 1 (or printing heads 3) along the horizontal axis X (FIG. 7*a*) and in a position B (FIG. 2) for transferring image 5 from the pad to an object 6 to be decorated by pressing the pad on object 6 (better seen in FIG. 3) with displacement of pad 1 from the top downwards or from the bottom upwards with rectilinear movement preferably along the vertical axis Z (FIG. 7*b*). Preferably, to decorate object 6, the movement of pad 1 is downwards but object 6 may also be arranged in line with device 2 so that pad 1, to decorate object 6, for example after a translation along axis X, must perform a displacement upwards or object 6 must be moved downwards on pad 1.

Pad 1 has a flat printing surface 10 in position A at which pad 1 receives the ink or other solution from device 2 and it is substantially convex, that is, in the shape of a spherical cap or sharp, in position B at which pad 1 must transfer image 5 to object 6.

Preferably, structure 13 of the apparatus according to the invention comprises at least one arm 4 adapted to rotate about one end integral with a rotating drum 23 and carrying at least one pad 1 at the other end. Preferably, structure 13 includes four pads 1 integrally constrained by respective arms 4 to the rotating drum 23; a larger number of pads 1 may also be used and two or more pads may be carried by a single arm 4. Structure 13 is configured to have pad 1 in position A, in which arm 4 is substantially vertical and pad 1 is oriented upwards, to receive image 5 from device 2 (FIGS. 1, 7*a*) and in position B, in which arm 4 is rotated downwards and pad 1 is oriented downwards, to imprint image 5 on element 6 by means of a compression movement of pad 1 on object 6 (FIGS. 2, 3, 7*b*). In position B, arm 4 is preferably arranged in parallel to the vertical axis Z or it can form an angle preferably less than ninety degrees with axis Z; thereby, the rotating drum is rotated by an angle of 180° or a greater or lesser angle to rotate from position A to position B.

Preferably, a pre-drying device 20 is provided, such as a UV lamp, for partially curing image 5 just formed on pad 1 in position A, preventing the colors of the image from being mixed, and so as to make the image with such a consistency to be imprinted on object 6. The partial drying due to device 20 is such to allow obtaining a pasty image 5, preferably semi-solid and/or sticky, that is, adapted to adhere to object 6.

Preferably, a drying lamp 21 is provided in position B of pad 1 to dry image 5 imprinted on object 6 by pad 1.

Preferably, a cleaning device of pad 1 is provided, comprising an adhesive tape 86, two rollers 84 for winding and unwinding tape 86 and a support element 85 along which tape 86 slides and which serves as a contrast to pad 1 in the pad cleaning step.

Figure 5A:
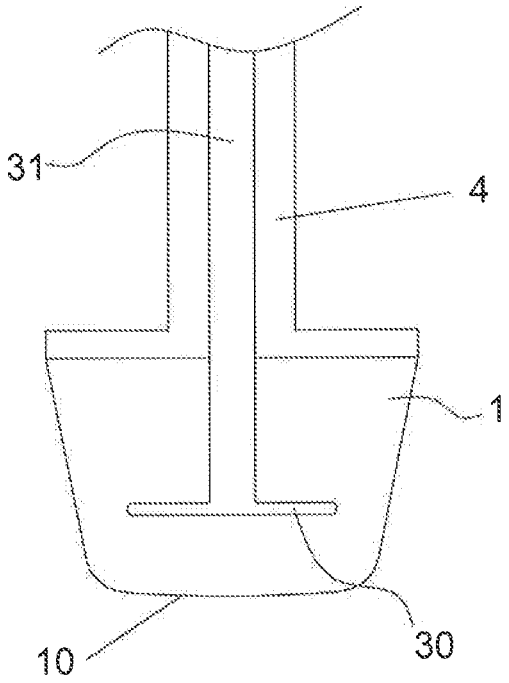
FIGS. 5*a*-5*b* show a type of pad usable for the apparatus in FIGS. 1 and 2.

Pad 1 consists of a mass, generally silicone, which has a surface 10 for printing; the interior of the pad has a cavity 30 roughly parallel to the printing surface, of very low volume and of such a surface to almost match the printing surface itself and arranged roughly parallel thereto (FIG. 5*a*). This cavity is put in communication with a rotating fluid dispenser 40 through an appropriate conduit 31 of suitable dimensions. The fluid inside cavity 30 can be left at atmospheric pressure, or the cavity can be forced to vacuum in order to help maintain the flatness of the printing surface 10 of the pad for receiving image 5. The rotating fluid dispenser 40 is in communication via a valve 32 with a tank with pressurized fluid 33 or with a depression or vacuum tank 34 controlled by respective vacuum and pressure pumps 35, 36, and respective vacuum/pressure regulators 37 in order to keep the pressure inside the cavity as much as possible unchanged and/or make the inflation and deflation of pad 1 quick.

Figure 1:
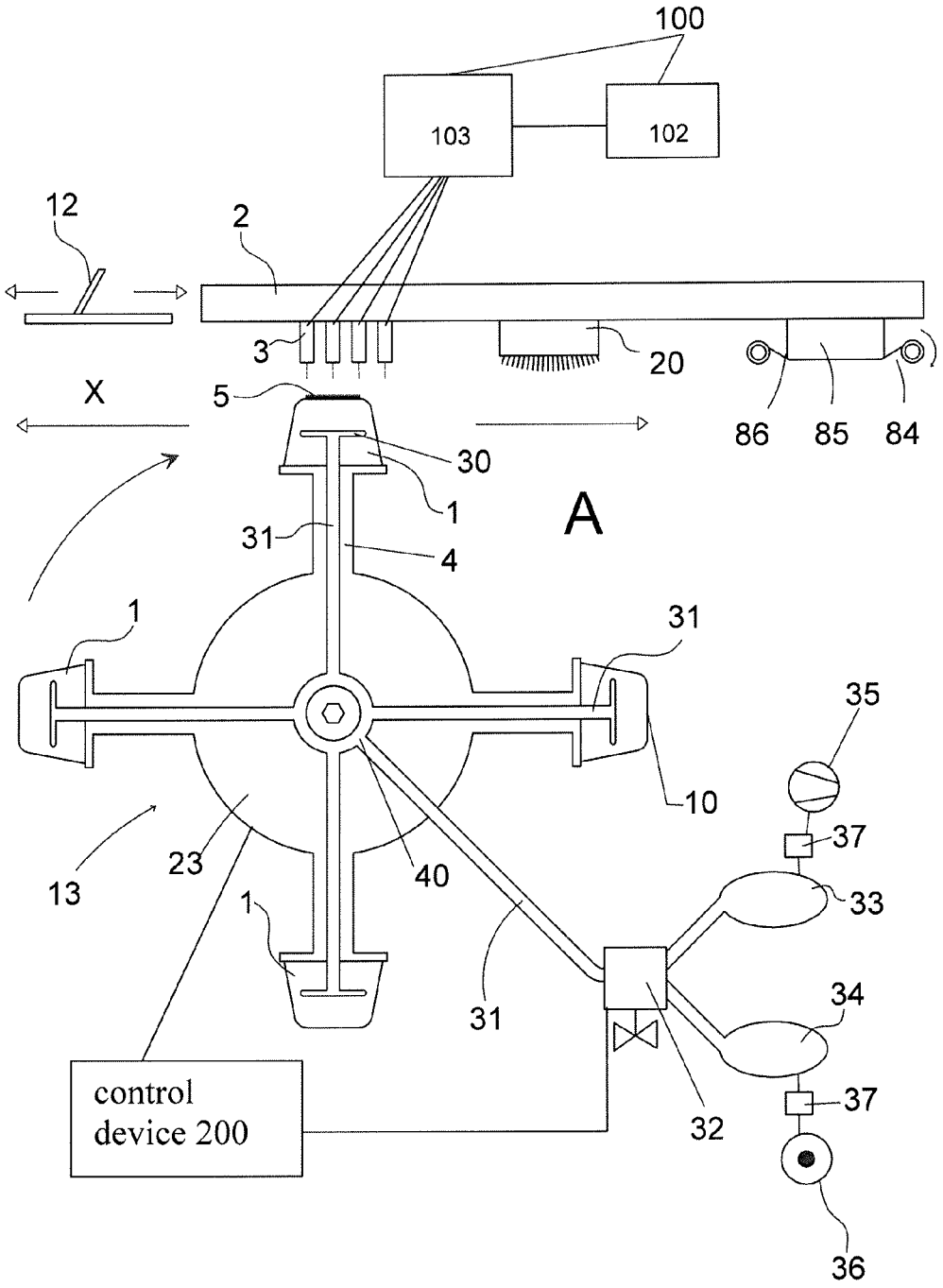
FIG. 1 shows a diagram of a printing apparatus with pad according to an embodiment of the present invention in a first working position.
Figure 2:
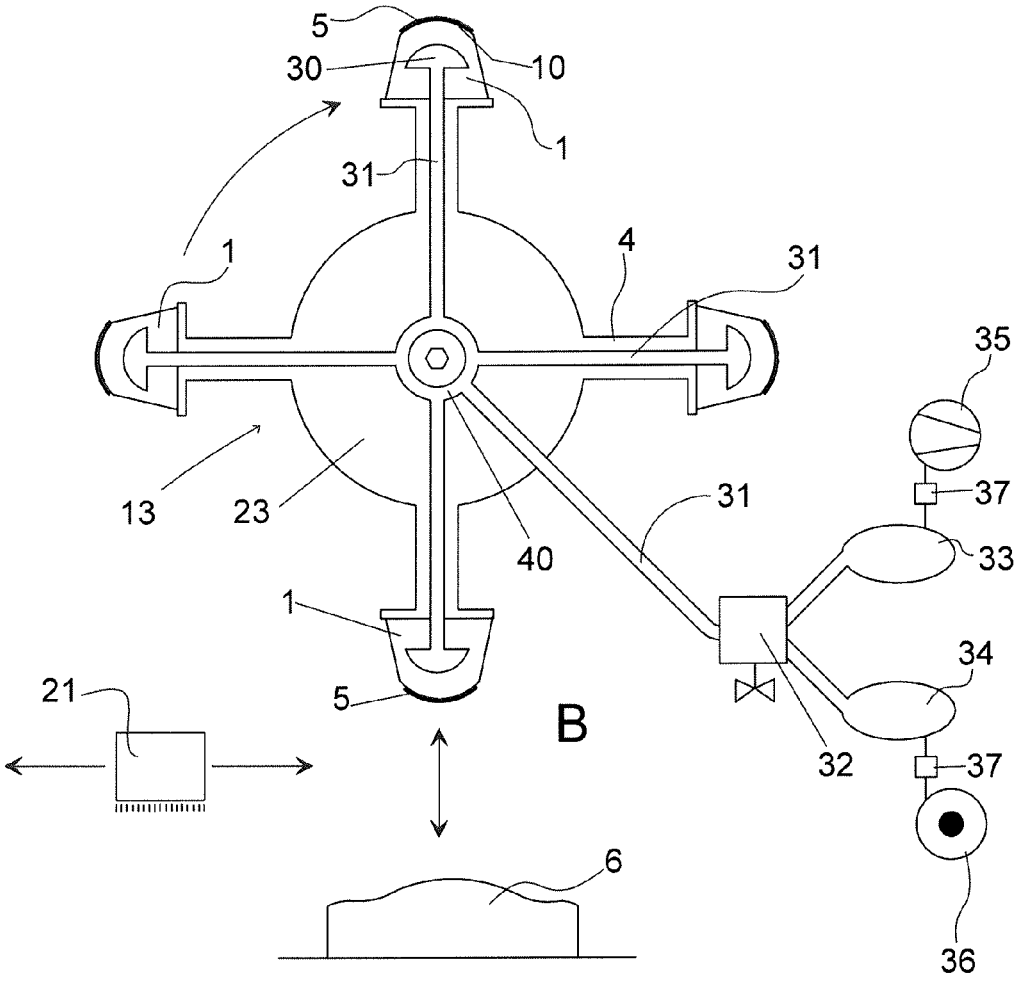
FIG. 2 shows a diagram of the printing apparatus with pad according to the embodiment of the present invention in a second working position.
Figure 3:
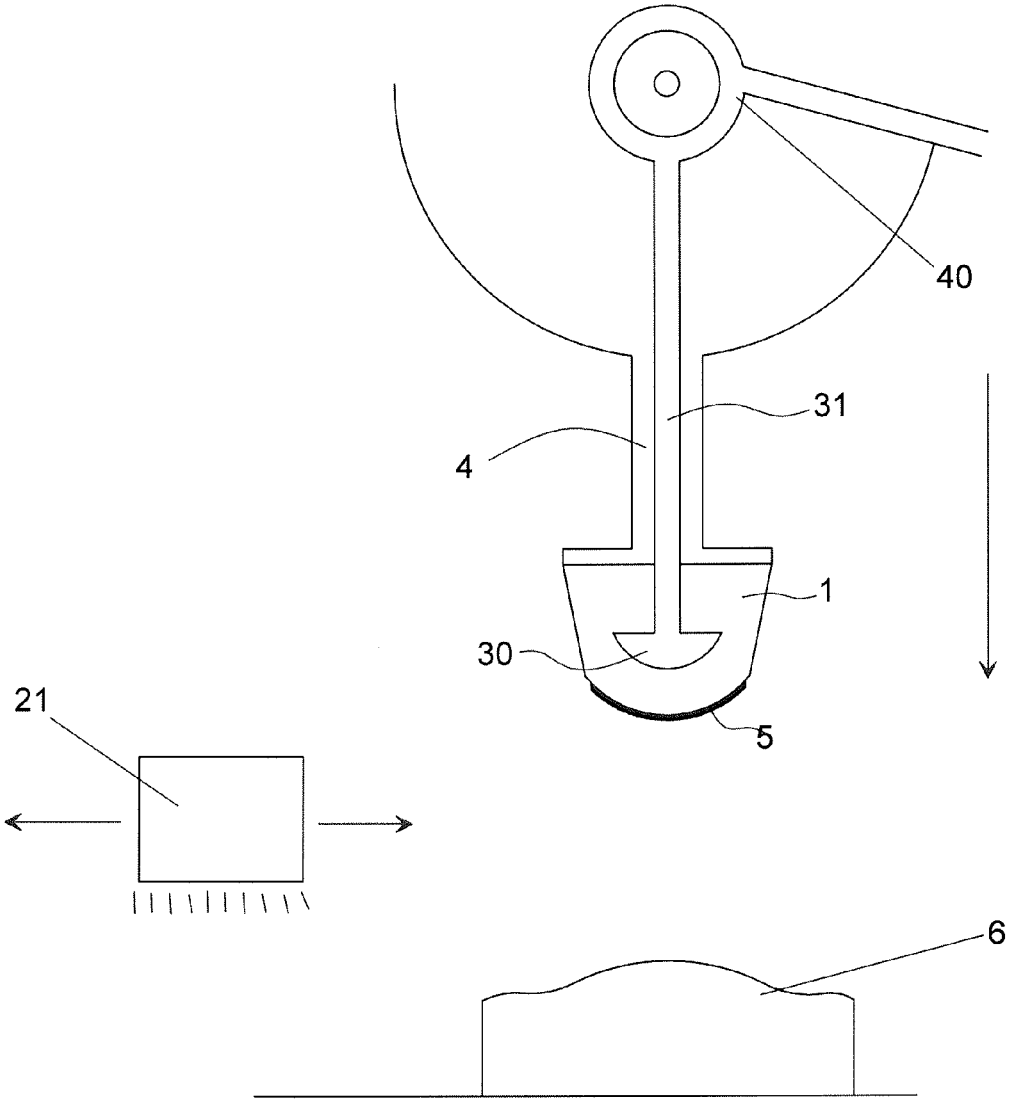
FIG. 3 shows in more detail a part of the apparatus in FIG. 2.

If the printing apparatus according to the invention includes a plurality of pads 1, for example 4 and each carried by a single arm 4 as in FIGS. 1 and 2, the rotating fluid dispenser 40 through conduits 31 of each pad provides for the simultaneous inflation and deflation of each pad. Alternatively, each conduit can be provided with a valve to put in communication or not cavity 30 of each pad 1 with four different controlled valves 32 and tanks 33, 34 so as to have simultaneously pads 1 with vacuum cavity and pads with pressurized cavity.

Two types of pads 1 may be used, which must both have a flat printing surface in position A and a substantially convex printing surface, i.e. pointed or at least rounded in position B.

A first pad (FIGS. 5*a* and 5*b*) obtains its printing surface 10 as flat already at rest (therefore, with the fluid in cavity 30 at atmospheric pressure or by exerting a slight vacuum to better maintain the flatness of the pad both when the pad is oriented upwards and when it is oriented downwards), which must then necessarily be deformed in the image release position B with the fluid in cavity 30 at a pressure which is higher than the atmospheric pressure.

The second type of pad (FIGS. 6*a* and 6*b*) has a sharp printing surface 10 at rest, which must then necessarily be made flat in step A in order to receive image 5 in an optimal and correct manner and this takes place by leading cavity 30 to vacuum (with a pressure which is lower than the atmospheric pressure) (FIG. 6*a*). In the step of releasing the image in position B, the fluid in cavity 30 is left at a pressure equal to the atmospheric pressure or is forced to a pressure which is higher than the atmospheric pressure, thus making the pad take back its natural shape (FIG. 6*b*).

Figure 5B:
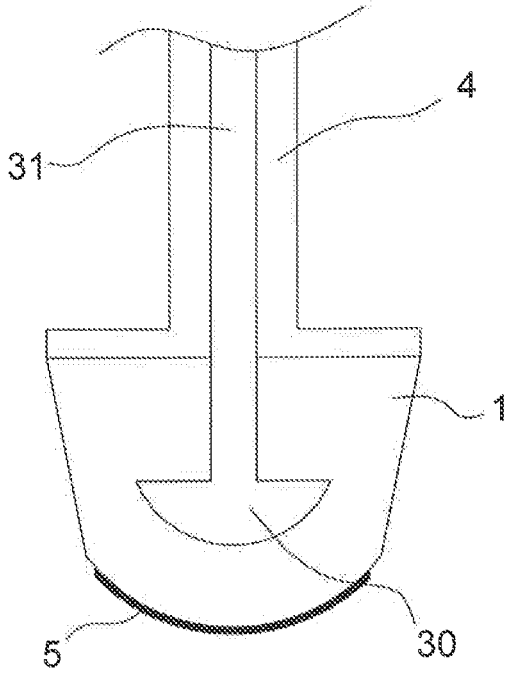

In the application example shown in FIGS. 1-3, the first type of pad is used (FIGS. 5*a* and 5*b*).

Pad 1 in position A with the fluid in cavity 30 at atmospheric pressure receives image 5 from the inkjet device 2 by means of a relative linear movement between pad 1 and printing heads 3. Image 5 is imprinted on the contrary on the surface 10 of pad 1 on the object, with backward color sequence, since the printed surface seen on object 6 is that previously transferred on the surface 10 of pad 1.

After receiving image 5 and after its optional pre-drying by device 20, pad 1 must transfer image 5 on object 6 in position B; in this position, the pad cannot release image 5 as it is, i.e., with a flat outer surface 10, for reasons due to the risk of air entrapment between object 6 and ink and of slippage of image 5 due to the slippage of pad 1, which, compressing onto object 6, can increase its surface, thus creating tensions and shifts resulting in loss of legibility and printing quality. The printing surface 10 must be made substantially convex, i.e. pointed or at least rounded; for this reason, it will be necessary to provide an increase in the pressure of the fluid in the cavity 30 of pad 1, for example by inflating cavity 30 through tank 33 controlled by valve 32 and by the respective pressure regulator 37. Image 5, in its pasty state, has no difficulty to undergo this slight deformation.

In an immediately subsequent step in position B, pad 1 is compressed in a conventional manner (such as by normal pad printing) so as to release image 5 on the object 6 to be decorated. The pad shape may be of rotation type, or square or rectangular or mixed.

A control device 100, comprising for example a computer 102 and a driver 103 for controlling and commanding the printing heads 3, activates device 2 to form image 5 on the surface 10 of pad 1 which undergoes the optional pre-drying to make it pasty. On pad 1, with surface 10 facing upwards, image 5 is deposited in an ordered manner by the printing heads 3, with nozzles oriented downwards, through movement of pad 1 parallel to the printing heads 3 along axis X. The movement of pad 1 along axis X goes beyond the position of the printing heads 3 up to device 20 for pre-drying image 5.

Thereafter, pad 1 is rotated preferably by 180° in order to be in front of object 6 in position B during this positioning, cavity 30 of the pad is inflated so that the printing surface 10 is substantially convex, that is, in the shape of a spherical cap or sharp. At this point, a vertical rectilinear relative movement between object 6 and pad 1 compresses the pad and transfers image 5 on the object 6 to be decorated. Finally, the ink or other solution on the printed piece may be hardened and then dried by another lamp 21, or object 6 may be removed and positioned manually or automatically on an external hardening device (such as a hot air or UV or combined oven, or by simple exposure to ambient air).

A control device 200 (such as a computer with associated drivers) controls the rotation of pad 1 and of arm 4 for the arrangement of the pad in positions A and B, the translation of pad 1 along axis X in position A, the inflation or deflation of cavity 30 inside pad 1, the compression of pad 1 on object 6 to release image 5 on the object 6 to be decorated with movement along axis Z and the optional lamp for hardening image 5. The control devices 100 and 200 are interconnected to allow the synchronism between the arrangement of pad 1 in position A and the deposition of the ink on the surface 10 of pad 1 and the pre-drying of image 5.

In particular, since the inkjet devices currently on the market mainly operate by spraying droplets downwards, the apparatus according to the invention takes this current limitation into account, which can be overcome in the future and accordingly, any man skilled in the art can suitably change the operation thereof if deemed easier.

The apparatus according to the invention may include one or more pads 1. The solution with multiple pads, such as 4 as shown in FIGS. 1 and 2, is adopted especially in those cases in which the image to be printed is distributed in a predominantly non continuous manner, on such a large surface (such as for example the front of a household appliance) to make the solution of a single pad of appropriate size unfeasible. In this case, image 5 is divided into as many portions as the available pads 1; pads 1 are put in communication through the rotating dispenser 40 with a controlled valve 32, in turn in communication with the vacuum/pressure tanks or alternatively, each of the pads may be in communication with a dedicated controlled valve. The cycle takes place similarly to that described above up to the pre-drying step included; at this point, rather than completing the cycle with the image deposition, it is more convenient to ink and pre-dry one by one the other pads, that is, the image portions 5 present in the printing surfaces 10 of pads 1. Thereby, all the pads are inked and ready for printing. The image deposition cycle takes place in the manner described above, pad by pad. The drying may take place simultaneously on the piece for all the images, either by means of lamp 21 or by an external device.

The relative movement between the inkjet device 2 and the at least one pad 1 is operated by servo-motors or motors of a different type but preferably the numerical control ones; thereby the control device 200, synchronized with the control device 100, precisely controls the deposition position of image 5 on the pad.

Pad 1 shown in FIGS. 5*a*-5*b* has a flat printing surface 10 (FIG. 5*a*) in position A in which it receives image 5 and, once pad 1 is inflated to print image 5 on object 6 in position B, it takes the shape of a spherical cap (FIG. 5*b*).

Pad 1 shown in FIGS. 6*a*-6*b* has a flat surface 10 (FIG. 6*a*) in position A in which it receives image 5 and, once pad 1 takes back its original shape to print image 5 on object 6 in position B, it takes a sharp shape (FIG. 6*b*).

In position A, cavity 30 has an internal volume so that, by exerting a vacuum and placing it in communication with a pressure which is lower than the atmospheric pressure, cavity 30 is completely closed; thereby, surface 10 of the pad is substantially flat. The pointed or spherical cap shape is obtained in position B by releasing the fluid and thus putting cavity 30 in communication with the atmospheric pressure, or with a pressure which is slightly higher than the atmospheric pressure.

Preferably, a further cavity may be present in addition to cavity 30 in the same pad 1, in communication or not with the external environment, to facilitate the deformation thereof.

Normally, pads 1 for pad printing are obtained by casting the rubber in a mold by gravity and are extracted after hardening of the material. Cavity 30 must be obtained by inserting a core in the mold, with the desired shape of the cavity, which can be manufactured in a destructible material or one that liquefies at temperatures lower than those acceptable by the rubber, such as for example easily pulverizable wax or resins; alternatively, the channel which connects cavity 30 with the exterior of the pad may be obtained directly with the core or with a removable tube once the rubber has hardened. Alternatively, cavity 30 may also be obtained by the insertion of a core made of rubber or flexible fabric connected by a pipe to the outside, which has at least one anti-adhesive side against the silicone rubber of the pad; so as to create the appropriate detachment and obtain the cavity under the action of the inflation/deflation fluid. According to another method, cavity 30 may be obtained by gluing a rubber sole on a pad of suitable shape which acts as a printing surface which leaves an inside cavity free, similarly to what described in the previous solution.

Figure 4A:
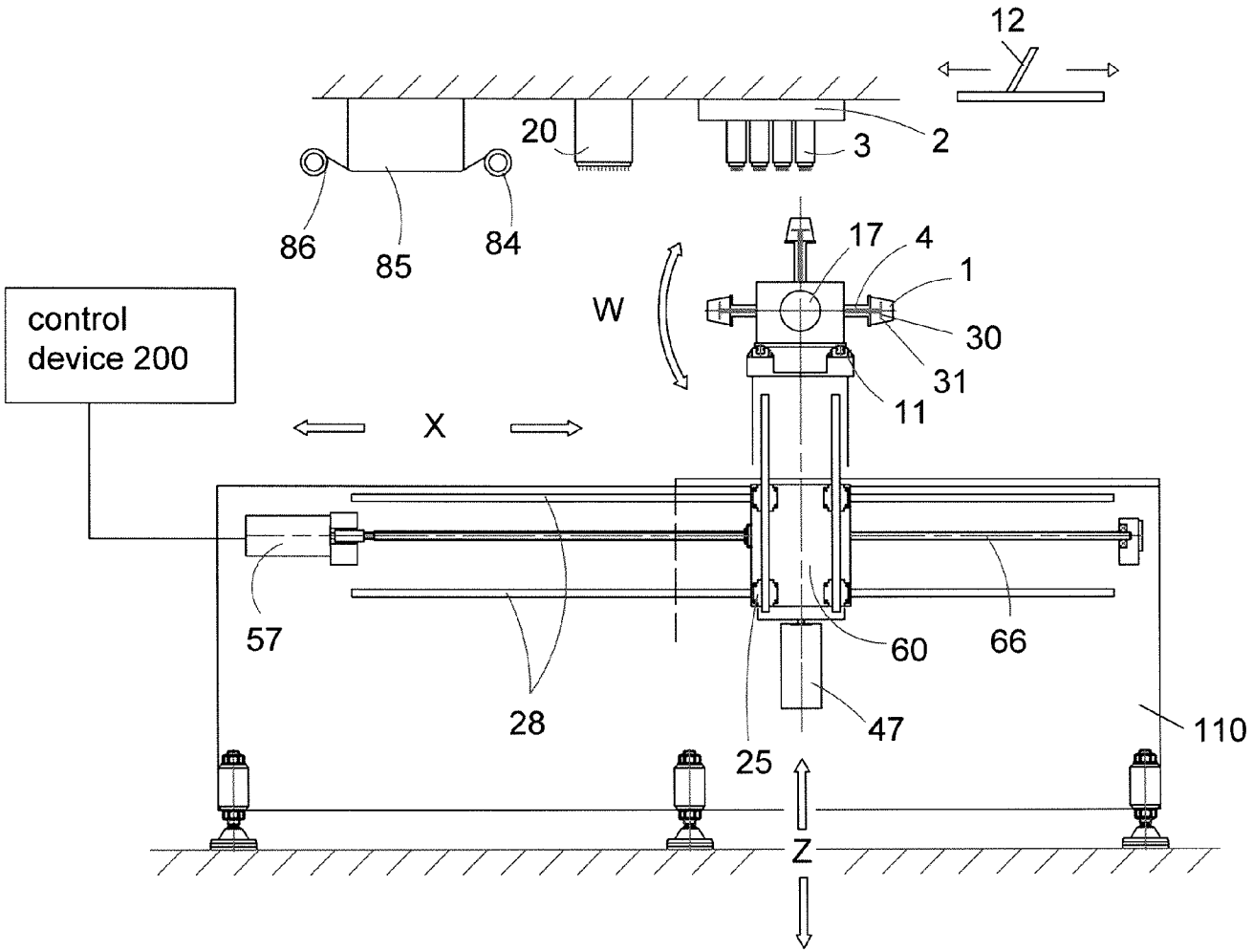
FIGS. 4*a*-4*c* are schematic views of the moving means of the apparatus in FIGS. 1 and 2.
Figure 4B:
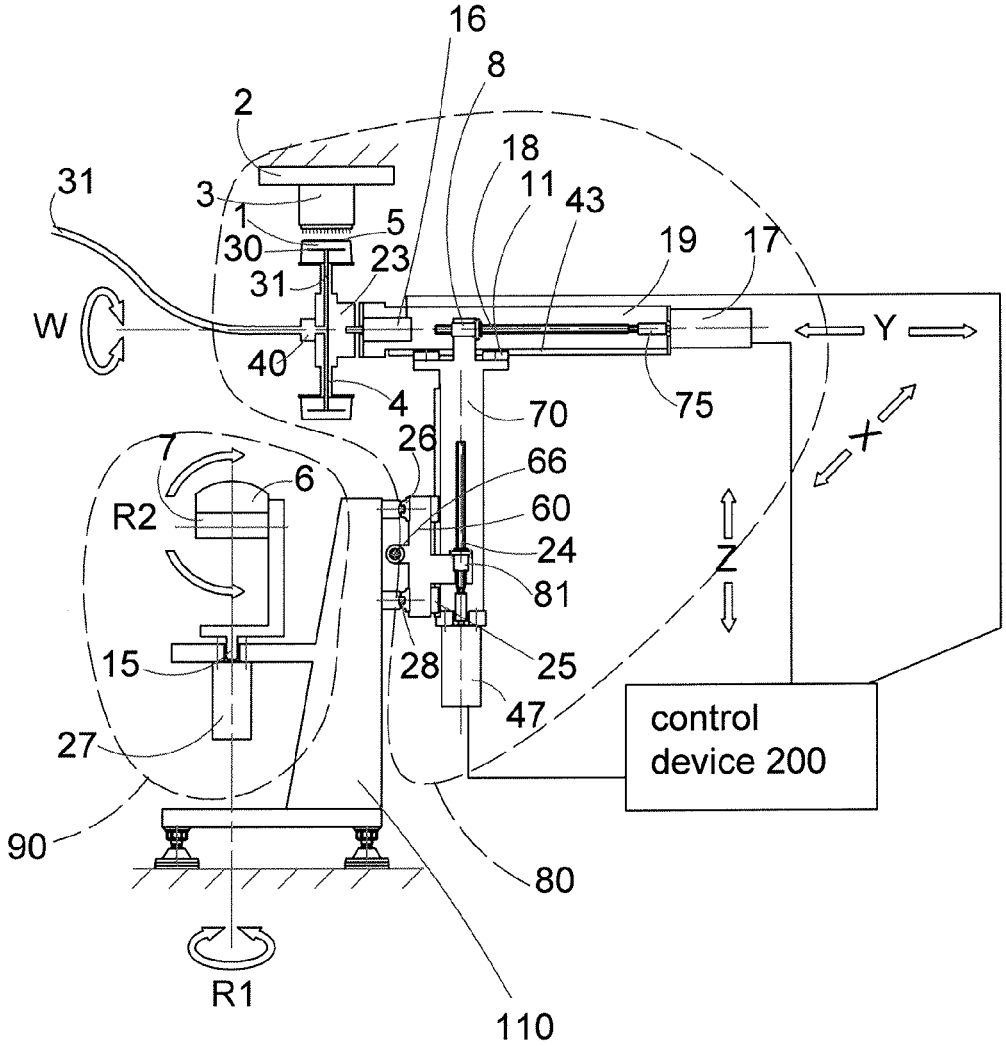
Figure 4C:
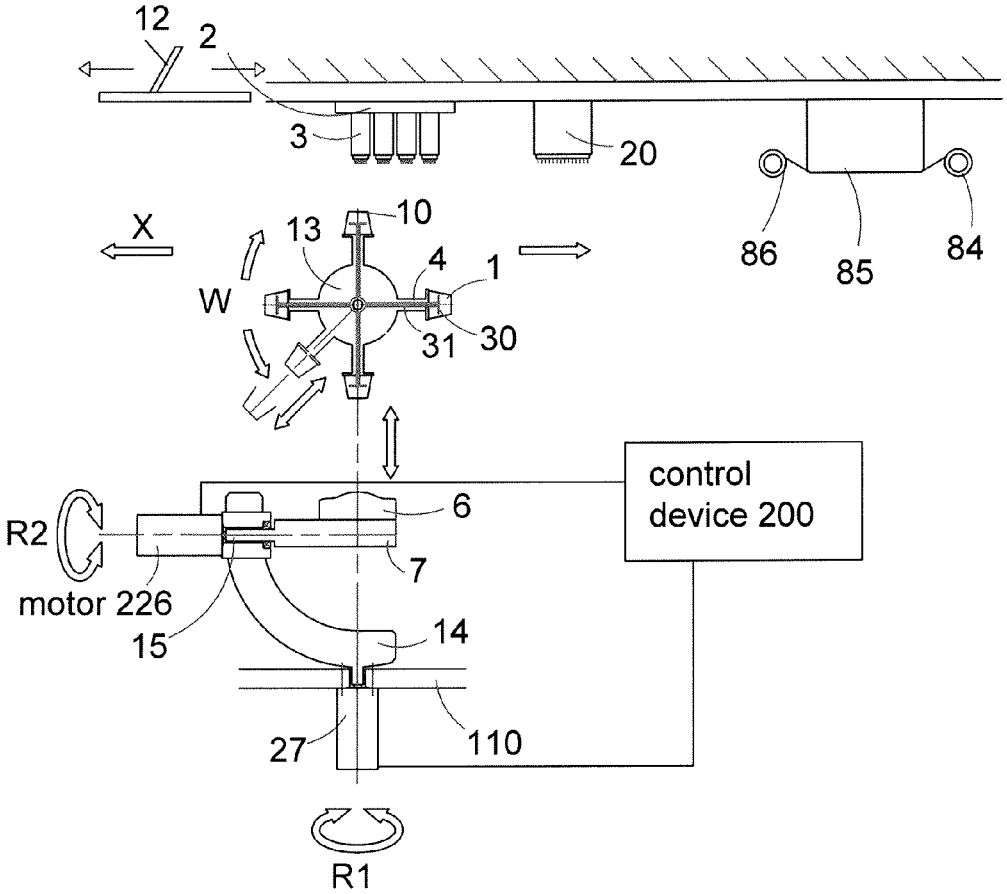

A possible implementation of structure 13 for moving the at least one pad 1, in particular of four pads 1, and its arrangement in positions A and B is shown in FIGS. 4*a*, 4*b* and 4*c*.

Structure 13 comprises a support frame 110 which is integral with a mechanism 80 for moving pads 1 and a mechanism 90 for moving object 6 to be printed; mechanisms 80 and 90 are preferably arranged on one side and on the other side with respect to frame 110. The mechanism 80 for moving pads 1 allows the translation of pads 1 along axes X, Y and Z and the rotation of the pads about an axis W parallel to axis Y while mechanism 90 for moving object 6 to be printed allows the rotation of object 6 about axis R1 parallel to Z axis and to an axis R2 substantially orthogonal to axis R1 or in some cases suitably inclined of a certain angle with respect to axis R1; the rotation and translation of pad 1 and of object 6 is preferably controlled by numerical control motors.

Preferably, mechanism 80 for moving pads 1 integral with the rotating drum 23, in turn integral with the rotor of an electric motor 16, comprises a carriage 19 integral with the stator of motor 16; carriage 19, translatable along axis Y, comprises an electric motor 17 on whose rotor a screw 18 is keyed through a joint 75. Screw 18, screwing on a nut 8, integral with a carriage 70 movable along axis Z, causes the translation movement of carriage 19 along axis Y by sliding on rails 43 through the linear sliding blocks 11 integral with carriage 70.

Carriage 70, translatable along axis Z, comprises an electric motor 47 on whose rotor a screw 24 is keyed through a joint. Screw 24, screwing on a nut 81, integral with a carriage 60 movable along axis X, causes the translation movement of carriage 70 along axis Z by sliding on suitable rails of the linear sliding blocks 25 integral with carriage 60 (better shown in FIGS. 4*a* and 4*b*).

Carriage 60, translatable along axis X, comprises an electric motor 57 on whose rotating shaft a screw 66 is keyed through a joint. The screw, screwing on a nut, integral with the support frame 110, causes the translation movement of carriage 60 along axis X by sliding on suitable rails 28 of the sliding blocks 26 integral with the support frame 110 (better shown in FIGS. 4*a* and 4*b*).

Object 6 is carried by a rotating piece holder 7 set in motion by the rotor of motor 226 connected thereto via a joint 15. The stator of motor 226 is integral with a curvilinear support element 14 in turn integral with the rotor of an electric motor 27 whose stator is rigidly constrained to the support frame 110. Mechanism 90 thus described is able to rotate object 6 about axis R1 and axis R2. The electric motors 16, 17, 27, 47, 57, 226 are all controlled by the control device 200 as well as the pressure/vacuum regulators 37, the pre-drying device 20, valve 32 and preferably the pad cleaning device.

The operation of a printing apparatus according to the invention and with four pads is described hereafter.

The control device 200 initially controls valve 32 to act, through circuit 31, on cavity 30 so that the surface 10 of pad 1 takes a flat shape. The electric motor 16 rotates drum 23 to move one of the four pads so that the printing surface 10 is positioned horizontally upwards, as in FIGS. 1 and 7*a*; the various electric motors of the apparatus are controlled to position the pad on a plane parallel to the printing heads 3, at a close distance from the printing nozzles. At this point, the electric motor 57 which allows the translation of pad 1 along axis X is controlled by the control device 200 to impose a controlled movement to the pad so that the latter, sliding under the inkjet printing heads 3, receives a portion of image 5 which is sprayed by the inkjet heads controlled by the control device 100 interconnected with the control device 200. Thereby, the portion of image 5 is deposited in an orderly and optimal manner on the surface of pad 10. Once the path of pad 1 under the inkjet printing heads 3 is completed, pad 1 continues its movement along axis X to reach and go beyond the pre-drying device 20, leading the portion of image 5 to a pasty state. The control device 200 then controls the electric motor 16 to rotate drum 23 by 90° so as to have another pad 1 (always with a flattened shape) in the position with the horizontal surface 10 upwards for depositing another portion of image 5 and for pre-drying it. The same operation is also carried out for the third and fourth pads, including pre-drying. The rotating drum 23 moves the four pads bearing the four portions of image 5, ready to be transferred in the predetermined positions on the object 6 to be decorated.

The operation of transferring image 5 on object 6 takes place as follows: the control device 200 controls valve 32 to introduce a pressurized fluid in circuit 31, and thus in cavity 30 of the four pads 1, simultaneously so that the printing surface 10 takes a substantially convex shape, that is, pointed or spherical cap (as shown in FIG. 2). Thereafter, pad 1, preferably the first to have received image 5 from the inkjet printing heads 3, is oriented downwards (i.e. towards object 6 to be printed) and simultaneously the object, moved by motors 27 and 226, is oriented so that the surface of the piece to be printed is orthogonal as much as possible to the image transfer movement of the pad which occurs later. At this point, after a translation along axes X and Y, the first pad 1 is ready to transfer the portion of image 5 on the object 6 to be decorated in position B. Thereafter, the vertical falling movement along axis Z due to motor 47 compresses pad 1 on object 6 which, due to its pointed shape (or at least spherical cap), imprints image 5 on object 6, following the shape thereof.

Alternatively to a rotation of the rotating drum 23 to bring each pad 1 in the position in which, by means of a perfectly vertical movement, the portion of image 5 is imprinted on object 6, by rotating drum 23 so that arm 4 which carries pad 1 is inclined by a certain angle with respect to axis Z and combining the movements along axis Z and along axis X (interpolation) for depositing the image on object 6, objects with double curvature may be printed.

Finally, once the piece is fully decorated, the final drying step of the ink may take place, which is carried out on board the machine by means of the most suitable solution, depending on the ink technology used (UV rays if UV inks are used, hot air or other) or outside the machine. As regards the other three pads 1, the image depositing cycle is obtained in a sequence by suitably rotating drum 23 and following a cycle similar to that of the previous pad 1 but concerning a different area of the surface of object 6.

According to a variant of the embodiment of the present invention, the movement of pad 1 relative to the printing heads 3 can take place along axis Y rather than along axis X by suitably arranging the printing device 2.

Alternatively to, or in combination with the printing device 2 of the digital type it is possible to use a serigraphy printing device 12 in the printing apparatus according to the present invention. Unlike the inkjet printing device, pad 1 remains stationary during the image deposition on the printing surface 10 and the doctor blade of the serigraphy printing device moves along axis X for depositing image 5 or a portion thereof on the printing the surface 10 of pad 1.

A number of serigraphy printing devices 12 equal to the number of pads 1 may also be used.

According to another variant of the embodiment of the present invention, the apparatus comprises at least one arm 4 carrying pad 1 but not connected to any rotating drum; as only difference compared to the embodiment already shown, said other variant of the embodiment of the invention comprises, in place of the rotating drum, a structure 140 which is able to translate along the horizontal axis X and is capable of translating from the bottom upwards or vice versa, and is connected to the at least one arm 4.

Figure 8:
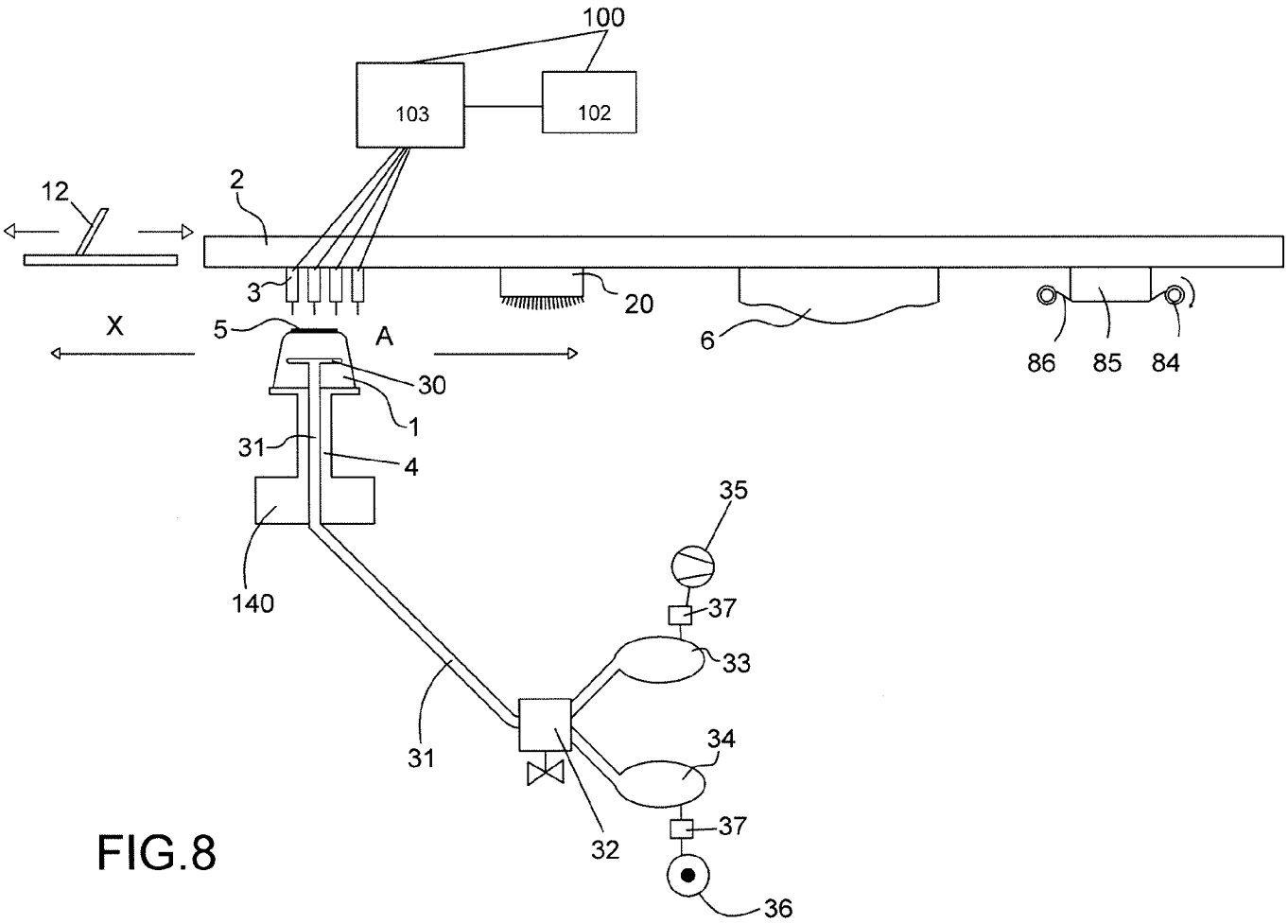
FIG. 8 shows a diagram of a printing apparatus with pad according to a variant of the embodiment of the present invention in a first working position.
Figure 9:
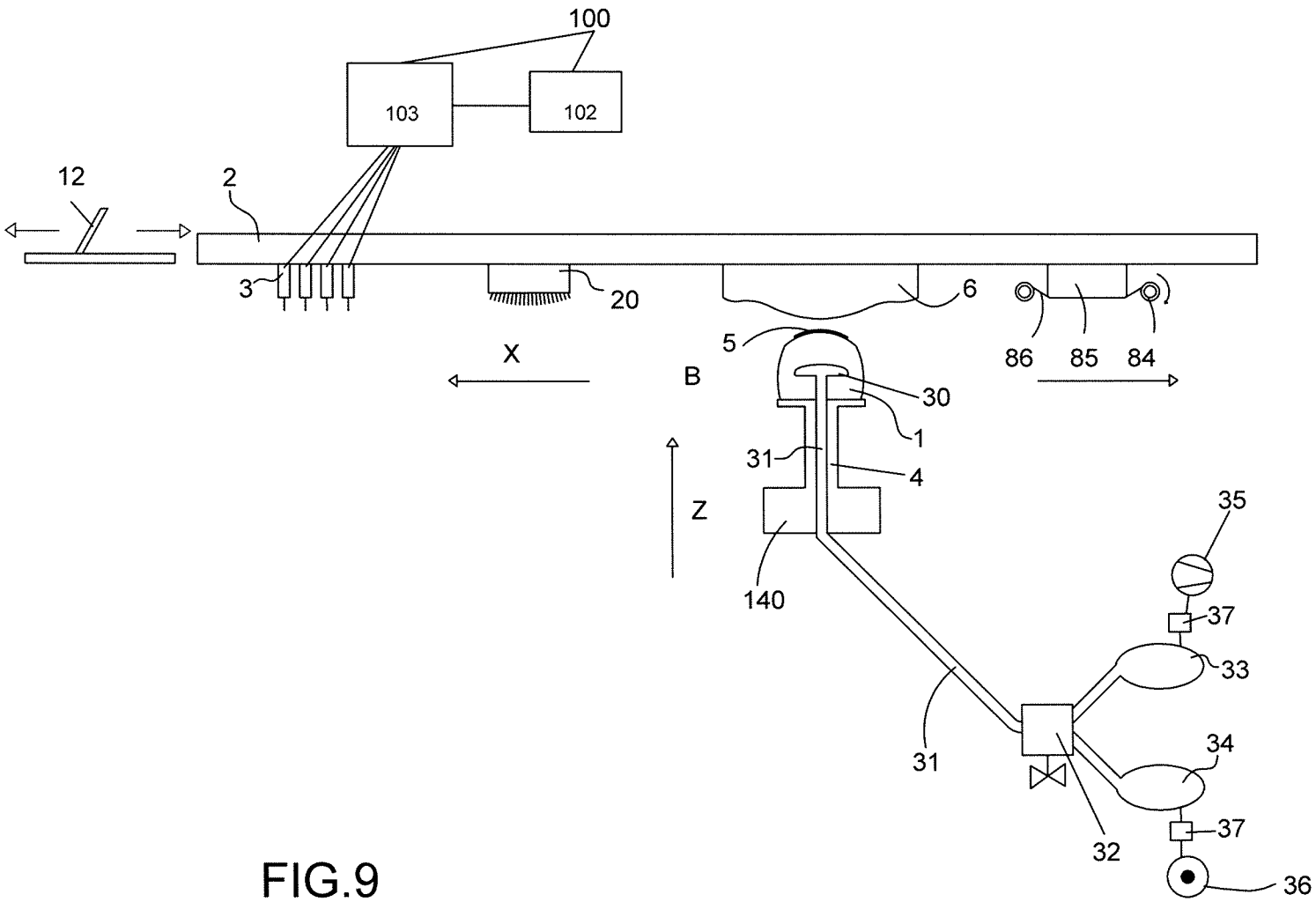
FIG. 9 shows a diagram of the printing apparatus with pad according to the variant of the embodiment of the present invention in an intermediate position between the first and the second working position.
Figure 10:
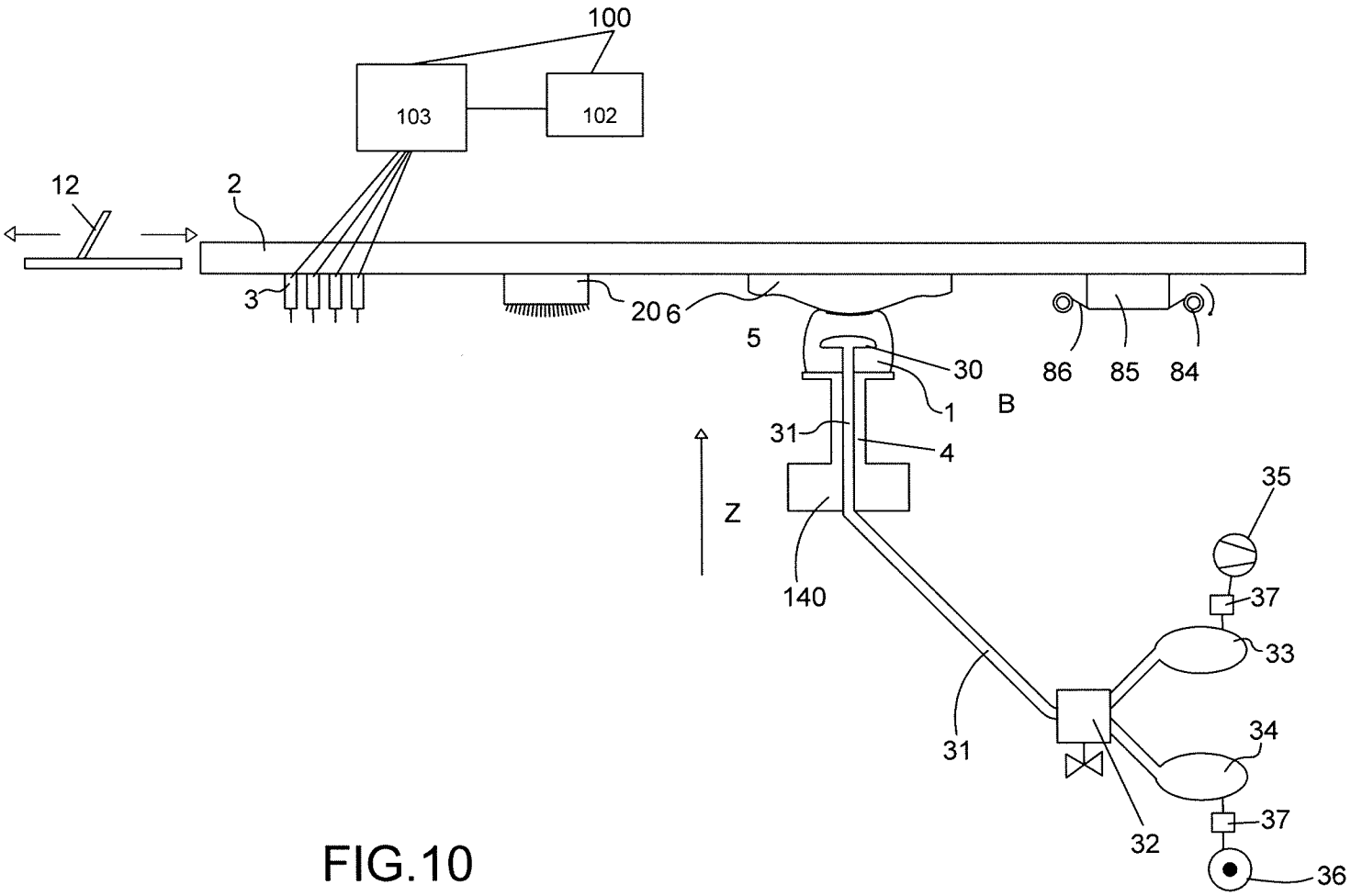
FIG. 10 shows a diagram of the printing apparatus with pad according to the variant of the embodiment of the present invention in the second working position.

In position A (FIG. 8), the deposition of image 5 of the printing device on pad 1 is achieved by relative translation along axis X of arm 4 or the printing heads 3 while arm 4 can move from the bottom upwards or vice versa (FIGS. 9, 10) in position B to imprint image 5 on the object 6 to be decorated. The apparatus is configured to arrange pad 1 in position A, in which arm 4 is substantially vertical and pad 1 is oriented upwards, to receive image 5 from device 2 (FIG. 8) and in position B, in which pad 1 is still oriented towards, to imprint image 5 on element by means of a compression movement of pad 1 on object 6 (FIG. 10). To move from position A to position B, arm 4 connected to structure 140 must translate along the horizontal axis X; preferably, electric motors or other mechanisms per se known allow the translation.

In position B, arm 4 is preferably arranged in parallel to the vertical axis Z or it can form an angle of preferably less than ninety degrees with axis Z.

Conduit 31 of the cavity 30 of pad 1 is in direct communication via a valve 32 with a tank with pressurized fluid 33 or with a depression or vacuum tank 34 controlled by respective vacuum and pressure pumps 35, 36, and respective vacuum/pressure regulators 37 in order to keep the pressure inside the cavity as much as possible unchanged and/or make the inflation and deflation of pad 1 quick.

The invention claimed is:

1. A printing apparatus comprising:

at least one pad comprising an inner cavity and a printing surface, a printing device adapted to form at least one image portion on the printing surface of the least one pad, wherein the printing apparatus comprises:

pad moving means adapted to orient the at least one pad in a first working position, on which said image portion is formed in said printing surface of the at least one pad by said printing device, by means of a relative movement between pad and printing device along a horizontal axis, said pad moving means being adapted to orient the at least one pad in a second working position different from the first working position and wherein said at least one image portion is imprinted on an object to be decorated by forcing the pad onto the object, by means of a relative rectilinear movement between the pad and the object to be decorated from the bottom upwards or from the top downwards, further means adapted to act on the cavity of the at least one pad to provide a flat shape of the printing surface of all the at least one pad in the first working position and a substantially convex shape of the printing surface of all the at least one pad in the second working position.

2. The printing apparatus according to claim 1, wherein said further means are adapted to force a vacuum into the inner cavity of the at least one pad in the first working position and are adapted to keep a fluid within said inner cavity of the at least one pad at atmospheric pressure or to force a pressure which is higher than the atmospheric pressure inside said cavity of the at least one pad in said second working position.

3. The printing apparatus according to claim 1, wherein said further means are adapted to maintain a fluid within said inner cavity of the at least one pad at atmospheric pressure in the first working position and to force a fluid at a pressure which is higher than the atmospheric pressure inside said inner cavity of the at least one pad in said second working position.

4. The printing apparatus according to claim 1, wherein the printing apparatus comprises pre-hardening means adapted to partially harden said at least one image portion in the first working position so as to make said at least one image portion pasty and adapted to adhere to the object to be decorated.

5. The printing apparatus according to claim 1, wherein the substantially convex shape of said printing surface of the at least one pad is a spherical cap.

6. The printing apparatus according to claim 1, wherein the substantially convex shape of said printing surface of the at least one pad is sharp.

7. The printing apparatus according to claim 1, wherein said pad moving means comprise an arm integral at one end to a rotating drum and carrying said at least one pad at other end, said arm being arranged substantially vertically in the first and second working position with said pad oriented upwards in said first working position and oriented downwards in said second working position.

8. The printing apparatus according to claim 1, wherein said pad moving means comprise an arm integral at one end to a rotating drum and carrying said at least one pad at other end, said arm being arranged substantially vertically in the first working position with said pad oriented upwards, said arm being arranged along an axis inclined by a given angle with respect to a vertical axis in said second working position with said pad oriented downwards.

9. The printing apparatus according to claim 1, wherein the further means comprise a conduit in connection with said inner cavity of the at least one pad, a first tank with a pressurized fluid and a second vacuum tank and a valve for connecting said conduit with the first or the second tank.

10. The printing apparatus according to claim 1, wherein said pad moving means comprise an arm integral at one end to a structure and carrying said at least one pad at other end, said arm being arranged substantially vertically in the first and second working position with said at least one pad oriented upwards both in said first working position and in said second working position, said structure being translatable along said horizontal axis for moving the at least one pad along said horizontal axis for switching from the first to the second working position.

11. The printing apparatus according to claim 10, wherein said printing device is an ink jet printing device and is adapted to form an ink image on the printing surface of the at least one pad.

12. The printing apparatus according to claim 1, wherein said printing device comprises at least one serigraphy printing device.

13. The printing apparatus according to claim 1, wherein said printing device comprises an ink jet printing device and at least one serigraphy printing device.

14. The printing apparatus according to claim 1, wherein the printing apparatus comprises other means adapted to dry an image printed on said object to be decorated in the second working position.

15. The printing apparatus according to claim 1, wherein the printing apparatus comprises means for cleaning the at least one pad by means of adhesive tape.

16. The printing apparatus according to claim 1, wherein the printing apparatus comprises a plurality of pads and a plurality of arms so that one or more pads are connected to a single arm, an image to be imprinted on the object to be decorated being decomposable into a plurality of portions whose number is equal to the number of pads, said printing device being adapted to form a portion of a plurality of image portions on a respective printing surface of a pad of the plurality of pads, pre-drying means adapted to partially dry all the image portions in the first working position so as to make them pasty and adapted to adhere to the object to be decorated and drying means adapted to dry an image on the object only after a complete formation thereof.

* * * * *